US006543702B1

(12) United States Patent
Stier

(10) Patent No.: US 6,543,702 B1
(45) Date of Patent: Apr. 8, 2003

(54) FUEL INJECTION VALVE

(75) Inventor: Hubert Stier, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/763,274

(22) PCT Filed: May 20, 2000

(86) PCT No.: PCT/DE00/01625

§ 371 (c)(1),
(2), (4) Date: Apr. 13, 2001

(87) PCT Pub. No.: WO00/79124

PCT Pub. Date: Dec. 28, 2000

(30) Foreign Application Priority Data

Jun. 19, 1999 (DE) ..... 198 28 204

(51) Int. Cl.[7] ..... B05B 1/08

(52) U.S. Cl. ..... 239/102.2; 239/533.2; 239/533.4; 239/533.11; 239/533.12; 239/585.1

(58) Field of Search ..... 239/102.2, 585.1–585.5, 239/533.1–533.12, 88–92; 123/298, 299

(56) References Cited

U.S. PATENT DOCUMENTS

| | | | | |
|---|---|---|---|---|
| 3,995,813 A | * | 12/1976 | Bart et al. | 239/102.2 |
| 4,033,507 A | * | 7/1977 | Fromel et al. | 239/585.1 |
| 6,027,049 A | * | 2/2000 | Stier | 239/585.1 |
| 6,092,743 A | * | 7/2000 | Shibata et al. | 239/533.12 |
| 6,308,901 B1 | * | 10/2001 | Nitkiewicz et al. | 239/533.2 |

* cited by examiner

*Primary Examiner*—Michael Mar
*Assistant Examiner*—Dinh Q. Nguyen
(74) *Attorney, Agent, or Firm*—Kenyon & Kenyon

(57) ABSTRACT

A fuel injector, especially an injection valve for fuel injection systems of internal combustion engines, has a valve-closure member, which can be actuated by an actuator, via a valve needle, and interacts with a valve-seat surface to form a sealing seat. In this context, a valve-needle axis of the valve needle forms a preselectable tilt angle with an axis of the actuator.

14 Claims, 3 Drawing Sheets

FUEL INJECTION VALVE

FIELD OF THE INVENTION

The present invention relates to a fuel injector.

BACKGROUND INFORMATION

A fuel injector is described in German Published Application. The fuel injector proceeding from this printed publication has a valve-closure member, which can be actuated by an actuator, via a valve needle, and interacts with a valve-seat surface to form a sealing seat. In this context, the fuel injector has a connection part and a functional part. An electrical connection and a fuel connection are provided at the connection part. The functional part has the actuator, a compression spring, and a valve-seat member, on which the valve-seat surface is formed. Therefore, the entire actuating device necessary to actuate the fuel injector is accommodated in the functional part. In connecting the functional part to the connection part, an electrical contact pin of the functional part is plugged into a socket of the connection part, whereby the actuator is connected to the electrical connection of the connection part. In addition, a fuel channel of the functional part is connected, in a sealed manner, to a fuel channel of the connection part. Because the connection part is bevelled on a connection side, on which it is connected to the functional part, the functional part can be connected to the connection part at a fixed slewing angle.

The fuel injector described in German Published Patent Application No. 197 12 591 has the following disadvantages. Since the actuating device is completely accommodated in the functional part, which is mounted in a tilted manner with respect to the connection part, the valve housing of the fuel injector has a bend in it. This makes it more difficult to insert the fuel injector in a connecting socket of the internal combustion engine, the fuel injector especially not being insertable in a cylindrical connecting socket. In particular, this fuel injector cannot be mounted in a cylindrical, receiving borehole of a cylinder head, as is required with fuel injectors that inject directly into the combustion chamber of an internal combustion engine.

The set-up of the electrical plug connection requires that the tilt angle of the fuel injector be already specified during the manufacture of the connection part. Therefore, tilt angle $\alpha$ can only be changed by modifying the manufacturing method. Since the fuel injector is subdivided into a connection part and a functional part in which the entire actuating device is accommodated, the fuel injector described in this printed publication is only suitable for this special fuel injector.

SUMMARY OF THE INVENTION

In contrast, the fuel injector of the present invention, has the advantage of the tilt angle being adjustable independently of the particular shape of the valve housing, so that the fuel injector can be used universally. In addition, the actuating device can be positioned in the fuel injector, independently of the angular position of the valve needle, so that the present invention is suitable for any fuel injector.

The valve-seat surface is advantageously formed on a valve-seat member, which rests against a spherical connecting surface on a valve housing of the fuel injector. The valve-seat member and the valve housing are thereby matched with each other in a particularly favorable manner, so that the tilt angle does not have to be fixed until the valve-seat member is attached to the valve housing. In this context, it is particularly advantageous when the valve-seat member is designed to be concave at the connecting surface.

It is advantageous when the valve housing has an opening, through which the valve needle protrudes, it being especially advantageous for the stepless adjustment of the tilt angle, when the cross-section of the opening is larger than the cross-section of the valve needle. This allows the valve housing and the valve-seat member to be manufactured independently of the tilt angle to be set, in which case the desired tilt angle can be set individually. Because the valve-seat member is connected to the valve housing by a welded seam, the tilt angle can be set with little outlay from a production engineering standpoint. As an alternative to a welded seam, the valve-seat member can also be attached to the valve housing by a screw cap.

The actuator is advantageously manufactured to be piezoelectric or magnetostrictive, which results in a variable valve-needle lift of the valve needle, and a large actuating force.

It is advantageous that the actuator acts on the valve needle, via an actuating element. As a result, the region of the valve on the discharge side of the fuel injector can be designed to have a narrow shape. This is especially sensible when using the fuel injector as an injection valve for directly injecting fuel into an internal combustion engine, since, in general, only a small mounting space is available at the combustion chamber, in the area of the fastening socket.

An end face of the actuating element advantageously rests against a valve-needle head of the valve needle. In this context, it is advantageous that the actuating side of the actuating element, and/or the valve-needle head is designed to be in the shape of a sphere segment or a lens. This ensures the accuracy of fit between the valve needle and the actuating element, regardless of what the tilt angle is set to.

It is advantageous that the actuator acts on the valve needle, via an actuator casing that seals the actuator. This results in a compact design of the fuel injector.

An end face of the actuator casing advantageously rests against a valve-needle head of the valve needle. In this context, it is advantageous that the end face of the actuator casing, and/or the valve-needle head, is designed to be in the shape of a sphere segment or a lens. This ensures the accuracy of fit between the actuator and the actuating element, regardless of what the tilt angle is set to.

DETAILED DESCRIPTION

Figure 1:
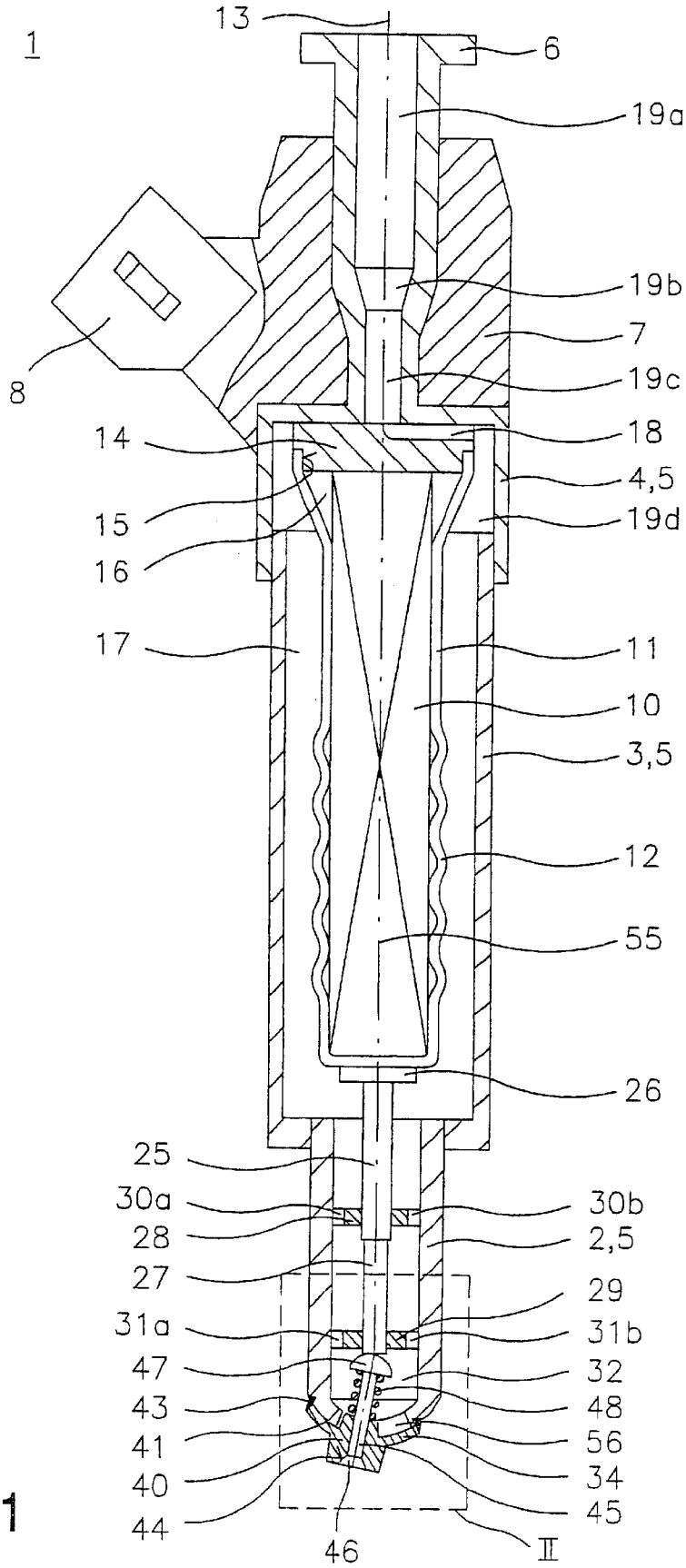
FIG. 1 shows an axial section through an exemplary embodiment of a fuel injector according to the present invention.

FIG. 1 shows a partial, axial sectional view of a fuel injector 1 according to the present invention. Fuel injector 1 is particularly used as a so-called direct gasoline-injection valve, for direct injection of fuel, especially gasoline, into a combustion chamber of a mixture-compressing, spark-ignition engine. However, fuel injector 1 of the present invention is also suitable for other applications.

Fuel injector 1 has a front part 2, a middle part 3, and a rear part 4, which together form a valve housing 5 of fuel injector 1. In this case, a fuel connection 6 is formed at rear section 4 of fuel injector 1. A section of rear part 4 of fuel injector 1 is surrounded by a plastic element 7, on which an electrical connection 8 is formed. An electrical cable can be connected to fuel injector 1, via the electrical connection.

An actuator 10, which is disposed in the middle part 3 of fuel injector 1, can be triggered by a control signal conveyed by the electrical wire. Actuator 10 is enclosed by an actuator casing 11, which has an elastic, undulated region 12, so that actuator casing 11 can be elastically deformed, especially in the direction of a longitudinal valve axis 13. In addition, actuator 10 is preloaded by elastic, undulated region 12. Actuator casing 11 is joined to a mounting surface 15 by a sealing plate 14. In this manner, an actuator chamber 16, in which actuator 10 is located, is hermetically sealed from an interior chamber 17 of fuel injector 1. Actuator 10 expands in response to being actuated, elastic, undulated region 12 of actuator casing 11 deforming elastically, so that actuator chamber 16 remains sealed from interior chamber 17. This protects actuator 10 against fuel present in interior chamber 17. In order to allow fuel to be fed from fuel connection 6 into interior chamber 17, sealing plate 14 has at least one opening 18, which is part of a fuel line 19*a* through 19*d*, 18 that leads into interior chamber 17.

Actuator 10 acts on actuating element 25, via actuator casing 11. In order for actuating element 25 to contact actuator casing 11 in an advantageous manner, actuating element 25 includes a pressure plate 26, which has an enlarged cross-section. In addition, actuating element 25 includes a segment 27 having a reduced cross-section. Actuating element 25 is guided by guide elements 28, 29 having slot-shaped openings 30*a*, 30*b*, 31*a*, 31*b*, through which the fuel flows out of interior chamber 17, into a fuel chamber 32.

Figure 2:
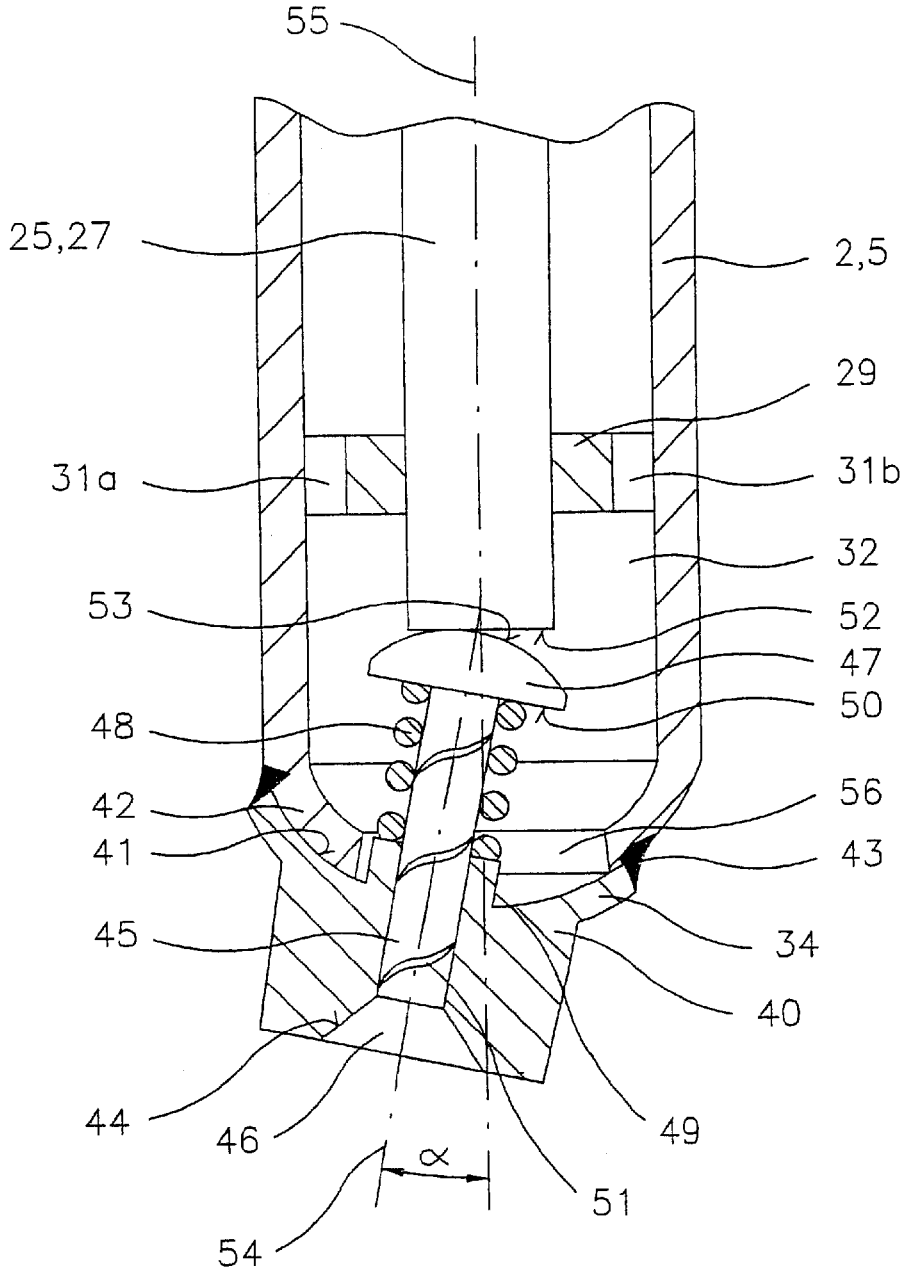
FIG. 2 shows the detail in FIG. 1 designated by II.

The remainder of the specification particularly focuses on the detail of fuel injector 1 that is denoted by II in FIG. 1. An enlarged view of this detail is represented in FIG. 2. In FIGS. 1 and 2, the same reference numerals are used for identical elements.

Attached to valve housing 5 of fuel injector 1 is valve-seat member 40, whose spherical connecting surface 41 rests against sphere-segment shaped end 42 of valve housing 5. In this exemplary embodiment, valve-seat member 40 is joined to valve housing 5 by a welded seam 43, which runs around at a concavely curved flange 34 of valve-seat member 40. Valve-seat member 40 has a valve-seat surface 44, which interacts with a valve-closure member 46 operable by a valve needle 45, to form a sealing seat. In the exemplary embodiment, valve needle 45 is connected to valve-closure member 46 and a valve-needle head 47 in one piece. By way of a closing force generated by a compression spring 48, which acts on valve needle 45 via valve-needle head 47, valve-closure member 46 is pressed against valve-seat surface 44, one side of compression spring 48 being supported on a shoulder 49 of valve-seat member 40, and the other side being supported on contact surface 50 formed on valve-needle head 47.

Fuel injector 1 is actuated by actuator 10, which can be designed to be actuated piezoelectrically, magnetostrictively, or (electro)magnetically. When actuator 10 is actuated, actuating element 25 is lifted, whereby valve needle 45 is actuated, and valve-closure member 46 is lifted off valve-seat surface 44. This causes fuel to be ejected from fuel injector 1 which, in this case, opens in an outward direction. For example, the fuel is supplied through a helical groove 51 formed on valve needle 45. Actuating element 25 acts on valve needle 45, via an end face 52, which rests against a curved, top surface 53 of valve-needle head 47 of valve needle 45.

A valve-needle axis 54 of valve needle 45 forms a tilt angle $\alpha$ with an axis of actuating element 25, which, in this exemplary embodiment, coincides with an axis 55 of actuator 10, tilt angle $\alpha$ being preselectable by horizontally sweeping valve-seat member 40 with respect to valve housing 5. In this exemplary embodiment, the axis of actuating element 25 also coincides with longitudinal valve axis 13 of fuel injector 1. In order that tilt angle $\alpha$ can be arbitrarily set, valve housing 5 has an opening 56, through which valve needle 45 protrudes. In this context, the cross-section of opening 56 is larger than the cross-section of valve needle 45. Before valve-seat member 40 is joined to front part 2 of valve housing 5 by welded seam 43, valve-seat member 40 can be arbitrarily displaced on connecting surface 41, at the end of valve housing 5, so that tilt angle $\alpha$ is infinitely adjustable. Since valve-seat member 40 is designed to be concave at connecting surface 41, the center of rotation is located in the interior of fuel injector 1, which means that valve-needle head 47 essentially remains in its position, top surface 53 of sphere-segment shaped valve-needle head 47 rolling on the planar end face 52 of actuating element 25, and due to the sphere-segment shape of valve-needle head 47, valve-needle head 47 can functionally rest against end face 52 of actuating element 25, at any tilt angle.

After tilt angle $\alpha$ is set, valve-seat member 40 can be attached to valve housing 25 by welded seam 43. The valve-seat member can also be attached in a different manner, e.g. using a screw cap.

Figure 3:
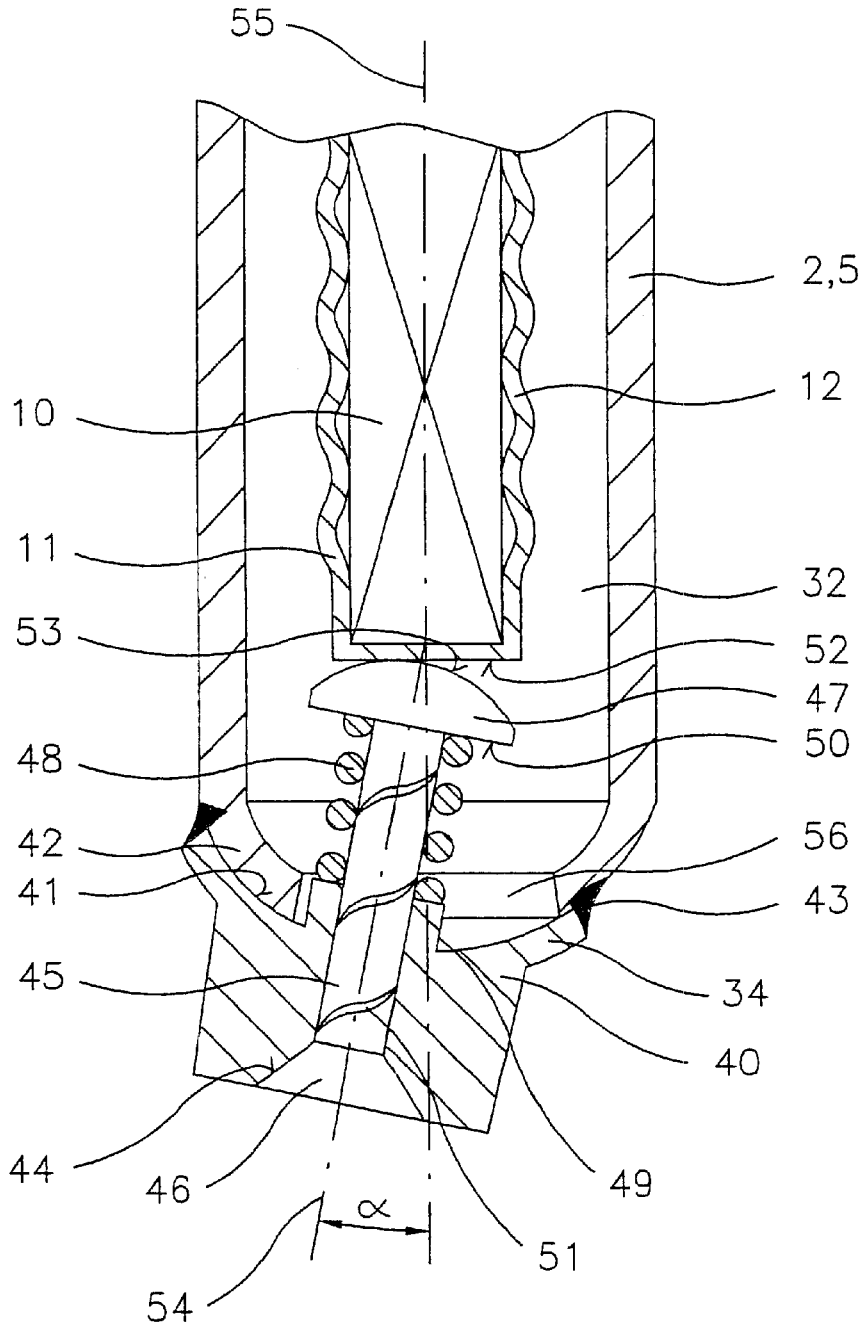
FIG. 3 shows an alternative exemplary embodiment of the detail designated in FIG. 1 by II.

FIG. 3 shows an alternative exemplary embodiment of the detail designated in FIG. 1 by II. Previously described elements are provided with consistent reference numerals, so that it is not necessary to describe them again.

In this exemplary embodiment, actuator 10 acts directly through an end face 52 of actuator casing 11, upon curved top surface 53 of valve-needle head 47 of valve needle 45. In this exemplary embodiment, end face 52 of actuator casing 11 is designed to be planar, so that sphere-segment shaped valve-needle head 47 rolls on end face 52 in response to actuator 10 being actuated, which allows valve-needle head 47 to advantageously rest against end face 52 of actuator casing 11.

The present invention is not limited to the described exemplary embodiments. In particular, the present invention is also suitable for a fuel injector 1, which opens in an inward direction.

What is claimed is:

1. A fuel injector, having a longitudinal axis comprising:

an actuator acting on a reciprocating member;

a valve needle mechanically linked to the reciprocating member, whereby force is transmitted from the actuator to the valve needle;

a valve-seat surface; and a valve-closure member that is actuated by the actuator via the valve needle and that interacts with the valve-seat surface to form a sealing seat, wherein:

the valve needle is angularly offset from the longitudinal valve axis, and a valve-needle axis of the valve needle forms a preselectable tilt angle with an axis of the actuator.

2. The fuel injector according to claim 1, wherein:

the fuel injector corresponds to an injection valve for a fuel injection system of an internal combustion engine.

3. The fuel injector according to claim 1, wherein:

the actuator includes one of a piezoelectric actuator and a magnetostrictive actuator.

4. A fuel injector, having a longitudinal axis comprising:

an actuator;

a valve needle;

a valve-seat surface;

a valve-closure member that is actuated by the actuator via the valve needle and that interacts with the valve-seat surface to form a sealing seat, wherein:

the valve needle is angularly offset from the longitudinal valve axis, and a valve-needle axis of the valve needle forms a preselectable tilt angle with an axis of the actuator;

a valve housing including a spherical connecting surface; and a valve-seat member on which the valve-seat surface is formed and that rests against the spherical connecting surface.

5. The fuel injector as recited in claim 4, wherein:

the valve-seat member includes a concave form at the spherical connecting surface.

6. The fuel injector according to claim 4, wherein:

the valve housing includes an opening through which the valve needle protrudes.

7. The fuel injector according to claim 6, wherein:

a cross-section of the opening is larger than a cross-section of the valve needle in order to adjust the tilt angle in a stepless manner.

8. The fuel injector according to claim 4, wherein:

the valve-seat member is connected to the valve housing by a welded seam.

9. A fuel injector, having a longitudinal axis comprising:

an actuator;

a valve needle;

a valve-seat surface;

a valve-closure member that is actuated by the actuator via the valve needle and that interacts with the valve-seat surface to form a sealing seat, wherein:

the valve needle is angularly offset from the longitudinal valve axis, and a valve-needle axis of the valve needle forms a preselectable tilt angle with an axis of the actuator; and an actuating element via which the actuator acts upon the valve needle.

10. The fuel injector according to claim 9, wherein:

an end face of the actuating element rests against a valve-needle head of the valve needle.

11. The fuel injector according to claim 10, wherein:

at least one of the end face of the actuating element and an end face of the valve-needle head includes a shape of one of a sphere segment and a lens.

12. A fuel injector, having a longitudinal axis comprising:

an actuator;

a valve needle;

a valve-seat surface;

a valve-closure member that is actuated by the actuator via the valve needle and that interacts with the valve-seat surface to form a sealing seat, wherein:

the valve needle is angularly offset from the longitudinal valve axis, and a valve-needle axis of the valve needle forms a preselectable tilt angle with an axis of the actuator; and an actuator casing for sealing the actuator and via which the actuator acts upon the valve needle.

13. The fuel injector according to claim 12, wherein:

an end face of the actuator casing rests against a valve-needle head of the valve needle.

14. The fuel injector according to claim 13, wherein:

at least one of the end face of the actuator casing and an end face of the valve-needle head includes a shape of one of a sphere segment and a lens.

* * * * *

UNITED STATES PATENT AND TRADEMARK OFFICE

CERTIFICATE OF CORRECTION

PATENT NO. : 6,543,702 B1
DATED : April 8, 2003
INVENTOR(S) : Hubert Stier

It is certified that error appears in the above-identified patent and that said Letters Patent is hereby corrected as shown below:

Column 1,
Line 10, change "Application." to -- Application No. 19712591. --

Signed and Sealed this

Seventeenth Day of February, 2004

JON W. DUDAS
*Acting Director of the United States Patent and Trademark Office*